US006050660A

United States Patent [19]

Gurley

[11] Patent Number: 6,050,660

[45] Date of Patent: Apr. 18, 2000

[54] STORAGE CABINET FOR ENGINE PARTS

[76] Inventor: Sherwin L. Gurley, 1513 Garden Pl., Waukegan, Ill. 60085

[21] Appl. No.: 09/220,507

[22] Filed: Dec. 24, 1998

[51] Int. Cl.[7] ..... A47B 97/00

[52] U.S. Cl. ..... 312/249.1; 312/249.11; 312/209; 312/229; 312/330.1; 280/47.26

[58] Field of Search ..... 312/249.1, 249.8, 312/249.11, 330.1, 229, 228, 348.3, 351, 210.5, 234, 234.1, 234.5, 902, 209, 236; 280/47.26, 47.19, 47.17, 47.35

[56] References Cited

U.S. PATENT DOCUMENTS

| | | | |
|---|---|---|---|
| 92,113 | 6/1869 | Smith | 312/210.5 X |
| 381,721 | 4/1888 | Randol | 312/229 |
| 923,165 | 6/1909 | Goldman | 312/348.3 X |
| 1,661,098 | 2/1928 | Side | 312/228 X |
| 2,119,640 | 6/1938 | Lundell | 312/229 X |
| 2,444,887 | 7/1948 | Wyeth | 312/236 X |
| 2,512,747 | 6/1950 | Lewis | 312/209 X |
| 2,893,749 | 7/1959 | Simonsen | 312/249.11 |
| 2,944,696 | 7/1960 | Effgen | 312/229 X |
| 3,233,952 | 2/1966 | Valentine | 312/229 |
| 4,085,987 | 4/1978 | Vartdal | 312/229 X |
| 4,402,144 | 9/1983 | Dumke | 312/229 X |
| 4,674,665 | 6/1987 | Van Kirk . | |
| 4,714,158 | 12/1987 | Oltman et al. | 206/349 |
| 4,762,688 | 8/1988 | Berry, Jr. . | |
| 5,048,902 | 9/1991 | Daly | 312/249.8 |
| 5,069,464 | 12/1991 | Braconnier | 280/47.35 |
| 5,117,979 | 6/1992 | Brightbill | 206/372 |
| 5,137,340 | 8/1992 | Cugley et al. | 312/234.5 |
| 5,160,026 | 11/1992 | Marsh | 206/373 |
| 5,207,723 | 5/1993 | Newby, Sr. | 312/249.11 |
| 5,240,264 | 8/1993 | Williams | 280/47.26 X |
| 5,244,265 | 9/1993 | Chiang | 312/107 |
| 5,378,005 | 1/1995 | Norton | 280/47.26 |
| 5,544,744 | 8/1996 | Oman | 206/319 |
| 5,607,213 | 3/1997 | Slivon et al. | 312/301 |
| 5,695,262 | 12/1997 | Wachtler | 312/229 |

*Primary Examiner*—Peter M. Cuomo
*Assistant Examiner*—James O. Hansen
*Attorney, Agent, or Firm*—Kenneth L. Tolar

[57] ABSTRACT

A storage cabinet for engine parts, tools and similar items includes a hollow cabinet member having a pair of opposing side walls, a rear wall, top and bottom walls and an open front face. Slidably received within the interior of the cabinet member and extendable from the front face are a plurality of drawers. Suspended within each drawer is a tray member having a plurality of recessed portions, each with identifying indicia adjacent thereto, for retaining a select item. Each recessed portion includes an aperture that drains to a bottom panel of the drawer. The bottom panel is angled downwardly toward a rear corner aperture through which fluid flows to a drain channel on the tray immediately therebelow. Accordingly, fluid eventually drains to the lowermost drawer and into a receptacle beneath the bottom wall of the cabinet member.

4 Claims, 2 Drawing Sheets

STORAGE CABINET FOR ENGINE PARTS

BACKGROUND OF THE INVENTION

The present invention relates to a cabinet for indexing and storing engine parts, tools and similar items having a fluid drainage means that collects grease, oil and similar fluids adhering to the items.

DESCRIPTION OF THE PRIOR ART

Automobile mechanics use numerous tools to remove or install various automobile parts. Once removed, the automobile parts are temporarily stored while the mechanic services the vehicle. Usually, the removed parts and tools are scattered in various locations such as shelves, work tables or similar support surfaces and are difficult to locate, when needed. Furthermore, the parts and tools are typically covered with grease, oil, lubricants and similar fluids which will drain onto the support surface.

The present invention solves the above enumerated problems by providing a storage cabinet having a plurality of drawers each having an indexing tray mounted therein. Each tray includes identifying indicia adjacent thereto allowing a user to quickly and conveniently catalogue items for later retrieval. Furthermore, the drawers and trays are uniquely configured to collect and drain fluids into a receptacle beneath the bottom wall of the cabinet.

Various tool and engine part storage devices exist in the prior art. For example, U.S. Pat. No. 5,378,005 issued to Norton relates to a portable tool truck having opposing doors on the front face and a plurality of storage compartments therein. The doors are pivotable in opposite directions into an overlapping arrangement to enclose the internal storage compartments.

U.S. Pat. No. 4,762,688 issued to Berry relates to an autoclave tray for surgical items.

U.S. Pat. No. 4,714,158 issued to Oltman relates to a molded tool tray assembly for use in a tool chest including a tray member having a rotatable, lockable handle attached thereto and a storage box adapted to rest in the tray member.

U.S. Pat. No. 4,674,665 issued to Van Kirk relates to a tool box positioned in and supported by the bed of a pick-up truck. The tool box has a pivoting lid to allow access to the tools and a side located drip rail channel to prevent entry of moisture into the tool box interior.

Although various tool box assemblies exist in the prior art, none include a fluid draining and collection means according to the present invention. In addition, unlike any of the prior art devices, the present invention includes a plurality of drawer mounted storage trays each having a plurality of recesses for storing various items and tools. Each recess includes identifying indicia adjacent thereto that allows a user to index the items for later retrieval.

SUMMARY OF THE INVENTION

The present invention relates to a device for conveniently storing and draining various auto parts and tools. The device comprises a storage cabinet having two opposing side walls, a rear wall, a top wall and a bottom wall. The front face of the storage cabinet is open and is in communication with an interior chamber for slidably receiving a plurality of storage drawers. Each drawer includes a front, a rear and two opposing side panels with a retaining lip on the interior surface of each side panel. An indexing tray is removably supported on the retaining lips, each including one or more recessed portions with identifying indicia adjacent thereto for cataloguing and storing a select engine part, tool or similar item. Each recessed portion includes a drain aperture for draining fluids from the part or tool to the bottom panel of the drawer. The bottom panel of each drawer is sloped towards a rear corner having an aperture adjacent thereto through which fluids received from the recessed portions are drained to the tray below. Each tray includes a drainage channel adjacent a corner thereof which is vertically aligned with the drain aperture on the drawer bottom panel therebove. The channel drains fluid into a recessed portion of the tray whereby the fluid continues to drain to the bottom panel and then to the tray therebelow. The fluid continues to flow in such a manner until it reaches the bottom wall of the cabinet. The bottom wall of the cabinet includes a centrally disposed drain aperture having a receptacle therebelow for collecting and storing the fluid for later use or disposal. It is therefore an object of the present invention to provide a cabinet that conveniently stores and indexes various engine parts and tools.

It is yet another object of the present invention to provide a device for storing engine parts and tools having a fluid draining means for collecting fluids adhering thereto.

It is yet another object of the present invention to provide a device for storing and indexing tools and automobile parts that minimizes the spillage and handling of hazardous waste associated therewith. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
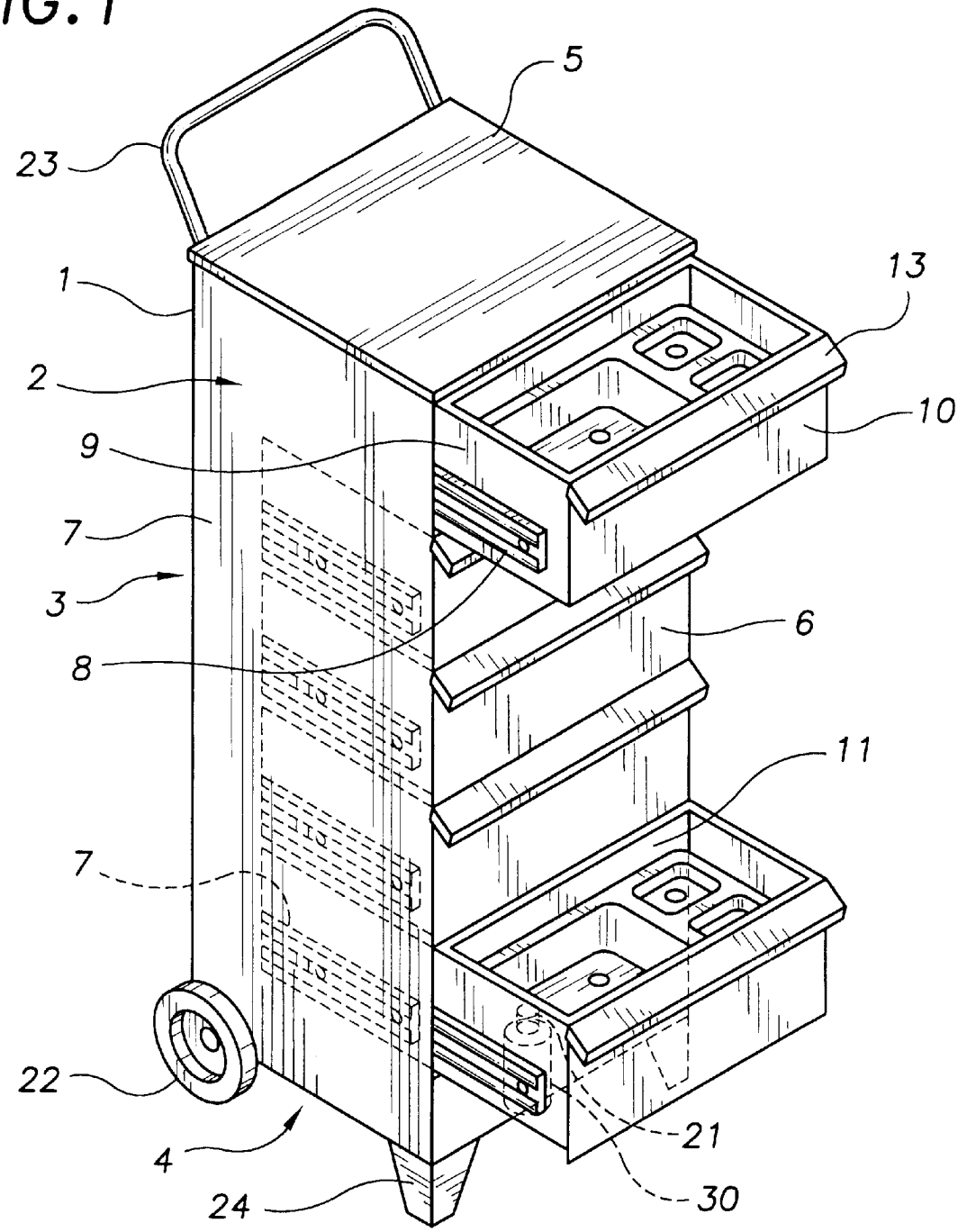
FIG. 1 is a perspective view of the inventive device.
Figure 2:
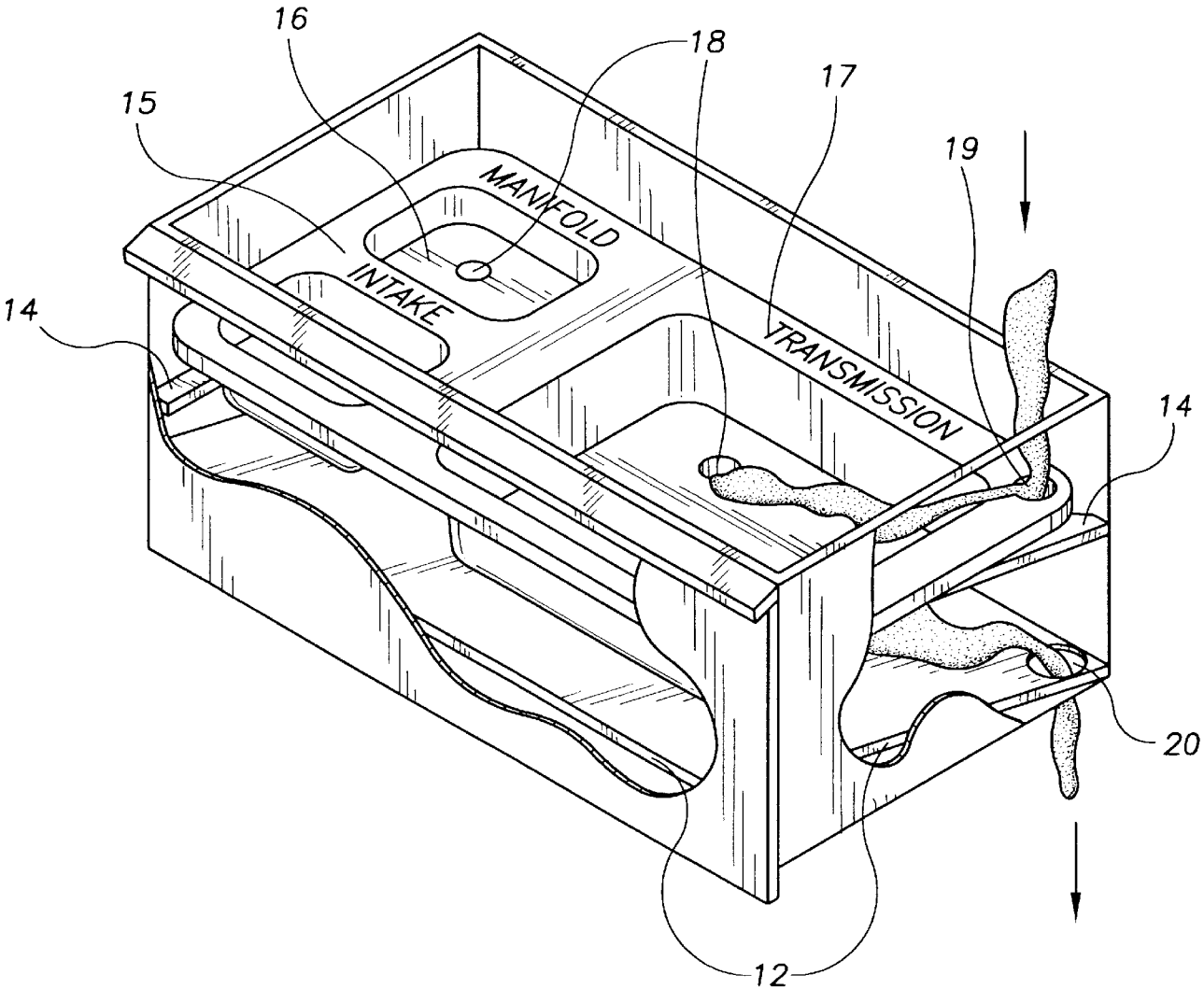
FIG. 2 is a perspective view of a drawer according to the present invention with a partial cut away view of the side walls thereof.

Referring now to FIGS. 1 and 2, the present invention relates to a storage device for indexing and draining various engine parts and tools. The device comprises a cabinet member 1 having two opposing side walls 2, a rear wall 3, a bottom wall 4, a top wall 5 and an open front face. The open front face is in communication with an interior chamber for receiving a plurality of storage drawers 6. Each side wall includes a track member 7 on an interior surface for slidably engaging a track member 8 on a storage drawer.

Each drawer 6 includes a pair of side panels 9, a front panel 10, a rear panel 11, a lower panel 12 and an open top. The top edge of the front panel includes a downwardly depending flange 13 which may be grasped by a user to slide the drawer into and out of the interior chamber. Each side panel has an exterior surface and an interior surface. On the exterior surface of each side panel is the track member 8 that slidably engages the track members 7 on the cabinet side walls allowing the drawers to be extended and retracted from the cabinet interior chamber.

Mounted to the interior surface of each side panel is a retaining lip 14 for supporting a storage tray 15 in a horizontal position within the drawer near its open top. Each tray is substantially rectangular and is dimensioned and configured to fit tightly within a designated drawer. Each tray includes a plurality of recessed portions 16 of varying sizes, each recessed portion having identifying indicia 17 adjacent thereto, allowing a user to catalog and store various engine parts, tools and similar items for later retrieval. Each recessed portion includes a drain aperture 18 through which fluids adhering to the items stored therein are drained to the lower panel of the drawer. Each tray further includes a drain channel 19 adjacent a corner thereof in communication with a recessed portion for collecting fluids draining from the lower panel of the drawer disposed thereabove. The lower panel of each drawer is sloped downwardly towards a rear corner aperture 20. The aperture 20 is substantially aligned with the drain channel on the tray immediately therebelow so that fluids accumulating on each tray eventually flow to the tray immediately therebelow.

The bottom wall of the cabinet eventually receives fluid from all of the drawers via the lowermost drawer. The bottom is sloped towards a substantially centrally disposed aperture 21. Immediately below the aperture is a receptacle 30, such as a plastic jug having a removable lid, which receives and stores the fluid from the bottom wall for later use or disposal. Accordingly, fluid contacting any of the storage trays serially drain from top to bottom until the fluids are eventually collected within the storage receptacle allowing the user to safely and conveniently dispose of the fluid at an appropriate time.

Attached to the bottom wall of the cabinet are a pair of axles having a wheel 22 at each of two ends allowing a user to conveniently roll the device from one location to another. Extending from a rear edge of the top wall of the cabinet is a substantially U-shaped handle 23 which may be grasped by a user when rolling the cabinet from one location to another. The bottom wall further includes a pair of support legs 24 extending from its bottom end adjacent the front of the cabinet for supporting the cabinet in a vertical position.

The various components of the above described invention, excluding the fluid storage receptacle, are constructed with a suitable material such as steel, stainless steel or similar equivalents. However, as will be readily apparent to those skilled in the art, the size, shape and materials of construction may be varied without departing from the spirit of the present invention. Although the device has been primarily described as being suitable for storing engine parts, the device may also be used to store various other items such as Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A storage cabinet for automobile parts comprising:

a hollow cabinet member having top and bottom walls, an interior chamber and an open front face in communication therewith, the bottom wall of said cabinet member sloped towards a substantially centrally disposed aperture;

a plurality of drawers slidably received within the cabinet interior chamber and accessible from the front face, each of said drawers including a front panel, two side panels, a rear panel and a bottom panel, said bottom panel of each of said drawers angled downwardly toward a rear corner thereof, said bottom panel including an aperture disposed proximal said corner through which a fluid can drain;

a horizontal tray suspended within each drawer, each of said trays including a plurality of recessed portions, each recessed portion having an aperture thereon and identifying indicia adjacent thereto allowing a user to conveniently index an item within said tray for later retrieval, said tray further including a drain channel in fluid communication with one of said recessed portions, said drain channel substantially aligned with and disposed beneath said aperture on a bottom panel therebelow whereby fluid serially flows from each drawer to a drawer therebelow and ultimately to a lower most bottom panel;

a receptacle immediately beneath the cabinet member bottom wall aperture for collecting and storing fluids drained from said trays.

2. A device according to claim 1 further comprising a pair of wheels attached to the bottom wall of said cabinet member to assist a user in rolling the device along a support surface.

3. A device according to claim 1 further comprising a U-shaped handle extending upwardly from the top wall of the cabinet member.

4. A device according to claim 1 further comprising a pair of legs extending from the bottom wall of said cabinet member to support said cabinet member above a supporting surface.

* * * * *